US006995739B2

(12) United States Patent
Lee et al.

(10) Patent No.: US 6,995,739 B2
(45) Date of Patent: Feb. 7, 2006

(54) VARIABLE COLOR DISPLAY AND ARTICLES INCORPORATING SAME

(75) Inventors: Tak Chun Lee, Hksar (CN); Hoi To Chow, Hksar (CN)

(73) Assignee: Zexus Technology Limited, (HK)

( * ) Notice: Subject to any disclaimer, the term of this patent is extended or adjusted under 35 U.S.C. 154(b) by 446 days.

(21) Appl. No.: 10/325,853

(22) Filed: Dec. 23, 2002

(65) Prior Publication Data

US 2004/0051722 A1 Mar. 18, 2004

(30) Foreign Application Priority Data

Sep. 13, 2002 (HK) ..... 02106725

(51) Int. Cl.
*G09G 3/36* (2006.01)

(52) U.S. Cl. ..... 345/88; 345/4; 368/84; 349/97; 349/106

(58) Field of Classification Search ..... 345/87–89, 345/205, 206, 4–6; 349/96, 97, 106; 368/80, 368/84

See application file for complete search history.

(56) References Cited

U.S. PATENT DOCUMENTS 3,162,008 A * 12/1964 Berger et al. ..... 368/80
3,763,647 A 10/1973 Shibanai
4,402,510 A * 9/1983 Yokoi ..... 273/153 S
4,707,141 A 11/1987 Havel
4,770,500 A * 9/1988 Kalmanash et al. ..... 349/80
5,228,013 A 7/1993 Bik
5,278,542 A 1/1994 Smith et al.
5,828,488 A 10/1998 Ouderkirk et al.
5,999,317 A 12/1999 Whitney
6,053,795 A * 4/2000 Whitney et al. ..... 446/219
6,147,937 A * 11/2000 Arikawa et al. ..... 368/242
6,262,842 B1 * 7/2001 Ouderkirk et al. ..... 359/487
6,618,327 B1 * 9/2003 Brewer et al. ..... 368/84
2002/0093284 A1 7/2002 Adachi
2003/0198141 A1 * 10/2003 Brewer et al. ..... 368/84

* cited by examiner

*Primary Examiner*—Xiao Wu
(74) *Attorney, Agent, or Firm*—Buchanan Ingersoll PC

(57) ABSTRACT

A display and a watch including a display which includes a first polarizing means, a second polarizing means, a display means, rotation means for causing relative rotation between said first and said second polarizing means, said second polarizing means being disposed intermediate between said first polarizing means and said display means, at least one of said polarizing means being a color polarizer, and said display means being generally reflective towards said first and second polarizing means.

12 Claims, 7 Drawing Sheets

VARIABLE COLOR DISPLAY AND ARTICLES INCORPORATING SAME

This application claims priority under 35 U.S.C. §§ 119 and/or 365 to 02106725.7 filed in Hong Kong on 13 Sep. 2002; the entire content of which is hereby incorporated by reference.

FIELD OF INVENTION

The present invention relates to means, schemes and arrangements of displays and, more particularly, to means, schemes and arrangements for a variable colour display. More specifically, this invention relates to means, schemes and arrangements for varying the colour of displays by polarizers. This invention also relates to articles, devices and apparatus with variable colour displays. Yet more specifically, although of course not solely limiting thereto, this invention relates to watches, clocks, other time-keeping devices and ornamental articles with a variable colour display as the dial.

BACKGROUND OF THE INVENTION

Display means, schemes and arrangements (collectively "Displays") are generally used in articles, devices, apparatus or systems as means of visual communication to the users, viewers or the general public. In many applications, it is desirable that Displays are provided with colour changing effects or capabilities without requiring complicated electronic control circuitry or delicate display screens. Watches, clocks, personal digital assistants (PDAs), personal computers, ornamental and decorative articles always find such colour variable Displays especially useful and provide additional aesthetic attraction to the users or the public.

For example, digital and analogue timepieces with variable colour Displays are described in U.S. Pat. Nos. 4,647,217 and 4,707,141. In U.S. Pat. No. 5,289,301, the broad concept of using colour modulation liquid crystal displays by adding guest dyes within a liquid crystal material to facilitate a variable colour dial in a wrist-watch has been described. In U.S. Pat. No. 5,636,185, a variable colour display scheme including a driving means for electronically controlling the liquid crystal display segments to change between a first colour, a second colour and intermediate shades of colour by applying prescribed voltages across selected liquid crystal display ("LCD") segments has also been described.

Displays utilizing a liquid crystal display material to produce the desirable colour variation features, including colour changing, suffer from major drawbacks. Firstly, electrical energy is required to control the liquid crystal display in order to produce the desirable colour changing visual effect. This would be undesirable for devices, for example, wrist-watches, which are expected to operate on a small power source for a pro-longed period of time. Secondly, variation of display colour is usually by electronically controlling a LCD layer interposed between two polarizers as described in U.S. Pat. No. 5,636,185. Such a LCD layer introduces additional thickness which is undesirable for articles or devices of compact and slim designs such as wrist-watches.

U.S. Pat. No. 5,278,542 describes a variable colour display utilizing a matrix of light-emitting dials (LEDs) which requires complicated driving and controlling circuitry as well as a bulky device which is not useful for many applications in which the size and power consumption are critical. U.S. Pat. No. 3,763,647 describes a watch dial which changes colour according to the ambient temperature by the coating of a liquid crystal film on the dial plate. In this application, the colour change cannot be adjusted or changed manually by the user.

Hence, it will be highly desirable and beneficial to provide improved means, schemes and arrangements of variable colour display which alleviate at least some of the shortcomings of the known colour variable Displays. Preferably, such Displays are provided without a complicated or bulky structure with costly components. In addition, it is highly desirable if such colour variable Displays can be controlled manually by the user without complicated adjusting steps or requiring a constant supply of electrical energy to effect or maintain the colour change.

OBJECT OF THE INVENTION

Hence, it is an object of the present invention to provide means, schemes and arrangements of variable colour Displays which facilitate colour changing without utilizing a costly liquid crystal display layer, and preferably without complicated or bulky circuitry or requiring a constant supply of electrical energy to maintain colour or colour change.

It is another object of the present invention to provide a means, scheme and arrangement of variable colour display which can be manually controlled and maintained by a user, preferably, such control can be performed without complicated steps or control.

It is a further object of the present invention to provide compact and slim variable colour Displays, such Displays preferably require no costly or delicate components and require no electrical power to maintain or to change colour. At a minimum, it is an object of the present invention to provide the public with a choice of means, schemes and arrangements of displays for use in articles, devices, apparatus and systems for the benefit and choice of the public.

SUMMARY OF THE INVENTION

Accordingly, it is a first aspect of the present invention to provide a display means or arrangement including a first polarizing means, a second polarizing means, a display means, rotation means for causing relative rotation between said first and said second polarizing means, said second polarizing means being disposed intermediate of said first polarizing means and said display means, at least one of said polarizing means being a colour polarizer, and said display means being generally reflective towards said first and second polarizing means.

Broadly speaking, there is provided in the present invention a display means or arrangement including a first polarizing means, a second polarizing means, display means, rotation means for causing relative rotation between said first and said second polarizing means, said second polarizing means being disposed intermediate between said first polarizing means and said display means, wherein at least one of said polarizing means being a colour polarizer.

Preferably, said colour polarizer being characterised with a colour filtering orientation wherein light of a polarization orientation parallel to said colour filtering orientation will be substantially colour filtered when passing through said colour polarizer and light of a polarization orientation orthogonal to said colour filtering orientation will pass through said colour polarizer generally unaffected by the colour filtering characteristic of said colour polarizer along said colour filtering orientation.

Preferably, said transflective medium includes a transflective film, wherein the reflective orientation of said transflective film being parallel to the colour filtering orientation of said colour polarizing means.

Preferably, said colour polarizing means includes a colour polarizing film, said colour filtering orientation of said colour polarizing means being substantially orthogonal to said transmissive orientation of said transflective medium.

Preferably, said colour polarizer and said transflective medium being contiguously stacked together.

Preferably, the reflective surface of said display means being contiguously stacked to said transflective medium.

Preferably, said second polarizing means being a colour polarizing means.

Preferably, the reflective surface of said display means includes a colour which is different to the characteristic colour of said colour polarizing means.

Preferably, said second polarizing means includes a colour polarizer which is rotatable by a gear transmission connected to a turning knob.

Preferably, said colour polarizing means and said transflective medium are a sub-assembly, said sub-assembly being connected to a turning knob via a transmission arrangement so that said colour polarizing means and said transflective medium are rotatable together.

Specifically, there is provided in the present invention a watch with needles incorporating the display means wherein the display means is underneath the display means.

More specifically, there is described in the present invention a watch, an article, an apparatus or a device including any or all of the above characteristics.

BRIEF DESCRIPTION OF THE DRAWINGS

Preferred embodiments of the present invention will be explained by way of examples and with reference to the accompanying drawings, in which.

DETAILED DESCRIPTION OF THE PREFERRED EMBODIMENTS

Figure 1:
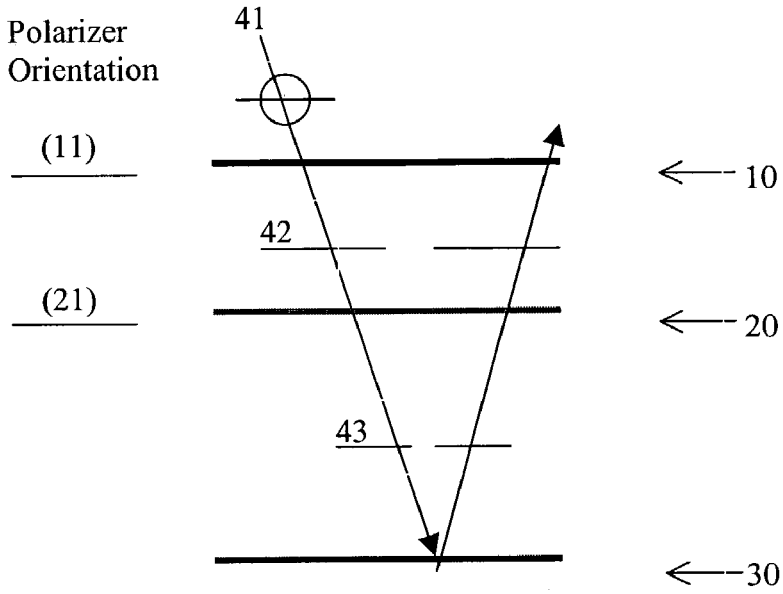
FIG. 1 is a schematic diagram illustrating the general principles of operation of a first preferred embodiment of the present invention in a first operative mode.
Figure 2:
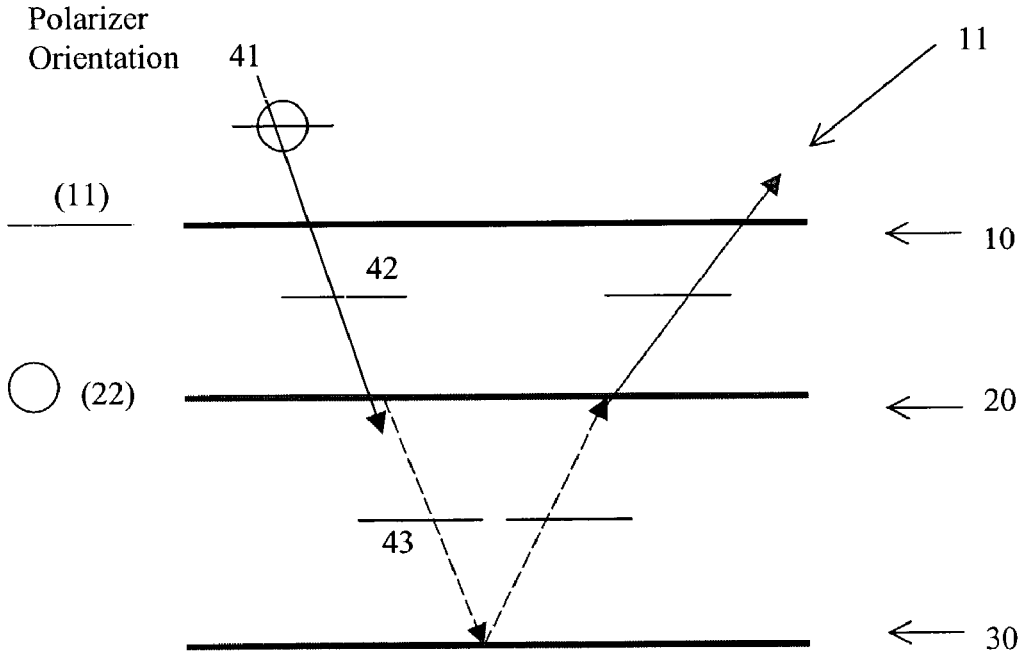
FIG. 2 is a a schematic diagram illustrating the general principles of operation of the preferred embodiment of FIG. 1 in the second operative mode.

Referring firstly to FIGS. 1 and 2, there is shown a schematic arrangement of a variable colour display means, scheme or arrangement (collectively, "Display" (1)). The Display 1 includes a first polarizing means 10, a second polarizing means 20 and a display means 30. The first polarizing means 10 is preferably a polarizer commonly known as a "neutral" polarizer with a first polarizing orientation so that only light of a polarization orientation parallel to the first polarizing orientation can pass through. Examples of such neutral polarizers are, for example, optical films available under product numbers SEG1425DU, SEG1425DUHC, SEG1425DUAG30G and the F1225 series from Nitto Denko of Japan. In this specification and generally, the terms "polarizing orientation", "polarization orientation", "polarizing direction" and "polarization direction" are equivalent and will be used interchangeably to the extent permissible and where the context is appropriate.

The second polarizing means 20 is a colour polarizer having a second polarizing direction 21 and a colour filtering orientation 22. A colour polarizer in the present context is a polarizer commonly known in the trade specifically as "colour polarizer". In general, a colour polarizer permits substantially through passage of light of one polarization orientation and filters light of another polarization orientation which is orthogonal to that one orientation, allowing light of a specific characteristic colour in that another polarization orientation to pass through. In this specification, the second polarizing orientation 21 of the colour polarizer 20 is the polarizing orientation which generally allows through passage of light while the colour filtering orientation 22 is the orientation which is orthogonal to the second polarizing orientation 21 and corresponds to the orientation at which the colour polarizer will act as a colour filter. Examples of suitable colour polarizers are, for example, products identified by product Nos. Q-10R, Q-10G, Q-10B from Nitto Denko of Japan and Product Nos. R-18255T, G-18250T, G3-18260T, B-18255T, B2-18625T, Y1-18288T, Yellow, Cyan, Magenta from Polatechno Co., Ltd. of Japan The display means 30 is preferably a coloured surface having a colour which is different to the characteristic colour of the colour polarizer 20. The coloured surface is preferably highly reflective so that incident light can be effectively reflected. The second polarizing means, namely, the second polarizer 20, is placed intermediate between the first polarizing means, namely, the first polarizer 10, and the display means 30.

The operating principles of the first embodiment of the present invention will now be explained with reference to FIGS. 1 and 2. Referring firstly to FIG. 1 showing the first operative mode, the first and the second polarizers are aligned so that the first polarizing direction 11 and the second polarizing direction 21 are parallel. The incident light 41 after polarized by the first polarizer 10 will then enter the space between the first and the second polarizers as the polarized incident light 42 and impinges on the second polarizer 20.

As the second polarizer is aligned with its polarizing direction parallel to the polarizing direction of the first polarizer, the polarized incident light 42 will generally pass through the second polarizer 20 and impinges on the display means which includes a display surface 30. The display surface 30 is preferably highly reflective so that a non-insubstantial portion of the incident light 43 can be reflected. The portion of the incident light that is reflected back towards the second polarizer 20 and the first polarizer 10 will generally pass through the polarizers and reach a viewer, since the first polarizer 10 and the second polarizer 20 are arranged in the transmissive mode in which their polarization directions are parallel. In this arrangement, as the colour polarizer 20 generally permits through passage of the incident light, the colour or the pattern of the display surface 30 will be seen by a viewer.

Turning now to FIG. 2, the second operative mode of the Display 1 is shown. In this arrangement, the polarizing orientation 21 of the second polarizer 20 has been turned or rotated with respect to the first polarizer 10 so that the second polarizing orientation 21 is orthogonal to the first polarizing orientation 11. It will be apparent that, at this moment, the colour filtering orientation 22 of the second polarizer 20 is parallel to the first polarizing orientation. Since the first polarizer 10 and the second polarizer 20 are now arranged so that only light polarized parallel to the colour filtering orientation 22 can reach the second polarizer 22, the incident light 41, after being polarized by the first polarizer as polarized incident light 42, will pass through the second polarizer 20 as polarized and filtered light 43. This polarized and filtered incident light 43 will be reflected by the top surface of the display means 30 towards the viewer.

In the present embodiment, since the second polarizer 20 is a colour polarizer which allows the component of the incident light polarized in the second polarizing direction 21 to pass through while acting as a filter to the light component polarized in the other, orthogonal, colour filtering orientation 22, by aligning the colour polarizer 20 so that its colour filtering orientation is parallel to the first polarizing orientation of the first polarizer, the incident light will be polarized, filtered and then reflected by the colour display means 30. The reflected light will be a result of colour interaction between the polarized filtered incident light 43 and the colour or colours of the display means 30.

Thus, for example, if the filtered incident light 43 is blue (i.e. the characteristic colour of the colour polarizer 20 is blue) and the display is magenta, the viewer will see a blue display in the present arrangement of the second operative mode. On the other hand, when the colour polarizer 20 is rotated back to the first operative mode so that its polarizing direction 21 is parallel to that of the first polarizer 10; incident light (assuming white without loss of generality) will pass through the first and the second polarizers towards the display surface 30 and the viewer will see the magenta colour of the display surface 30.

Hence, a viewer will see a first colour, which is the colour of the display surface, in the first operative mode of the arrangement of FIG. 1 while, in the second operative mode of the arrangement of FIG. 2, a user will see a second colour, which is the characteristic colour of the colour polarizer through reflection of the colour filtered light by the display surface 30.

When the relative polarizing directions between the first polarizer 10 and the second polarizer 20 is intermediate between the scenarios of FIGS. 1 and 2 so that the polarizing directions of the first polarizer and the second polarizer are neither parallel nor orthogonal, a colour resulting from the mixture of the colour of the colour polarizer 20 and the reflective surface 30 will be seen by a user. For example, if the characteristic colour of the colour polarizer 20 is red and the reflective display surface 30 is magenta, a user will see "magenta" in the arrangement of FIG. 1 in the first operative mode, "red" in the arrangement of FIG. 2 in the second operative mode and magenta of a variable quality in the intermediate arrangement. Furthermore, it will be noted that the quality of the "magenta" will gradually vary as the Display 1 moves gradually between the first operative mode and the second operative mode. Hence, a user can gradually vary the colour of the Display by gradually changing the relative polarizing orientation of the first and second polarizers.

Thus, it will be appreciated that, by varying the relative polarizing directions of the first polarizer and the second polarizer, the colour of the Display due to the light emerging from the arrangement and perceived by the viewer can be changed from a first colour to intermediate colours and finally to a second colour as the operative modes change from the first to the second, thereby constituting a variable colour display. It will further be appreciated that the variable colour display facilitated by placing the first polarizer and the second polarizer on top of the display surface results in a very compact and a slim design without requiring complicated, bulky and costly circuitry and component. Such a slim and compact arrangement is particularly useful for applications in which size or compactness is of a prime consideration as, for example, in the case of wrist-watches. Also, it should also be noted that the present invention can be realized by placing the colour polarizer above the neutral polarizer to achieve a similar variable colour display.

Furthermore, since the intensity of the incident light 41 will be substantially reduced after passing through the top polarizer 42 as a result of the blocking of the light component with a polarization direction orthogonal to that of the first polarizer 10, and this loss in intensity is worse in the second operative mode, as a result, the brightness of the Display in the second operative mode may not be aesthetically pleasing. Hence, it will be beneficial if the brightness of the Display can be enhanced to provide a more aesthetically pleasing Display. However, in fulfilling the aforesaid objective, especially in the second operative mode, it is highly desirable that the display quality in the first operative mode is not adversely affected.

To achieve this objective, the specific characteristics of a transflector or a transflective polarizer are utilized. In this connection, the term "transflective polarizer" or "transflector" generally refers to an optical component which includes a reflective polarizing element and a diffusing element such that the transflector diffusely reflects light of one polarization (the "reflective orientation") and transmits light of another polarization ("the transmissive orientation") which is orthogonal to the reflective orientation. A general description of transflective films which have the aforesaid characteristics of a transflector can be found in U.S. Pat. No. 6,262,842. Examples of suitable transflective films which can be utilized in the present invention include, for example, products available from 3M Innovative Properties Company of the USA under the product names TDF (V™ Transflective Display Film), or more preferably, RDF-C (Vikuiti™ Reflective Display Film-Clear).

Figure 3:
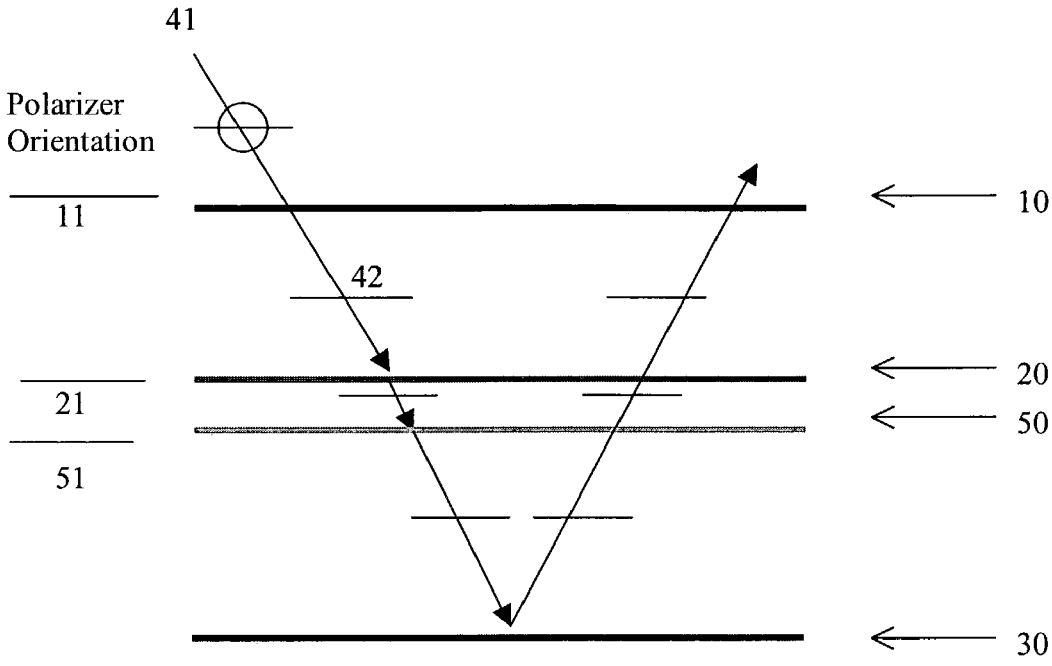
FIG. 3 is a schematic diagram illustrating the general principles of operation of a second preferred embodiment of the present invention in a first operative mode.
Figure 4:
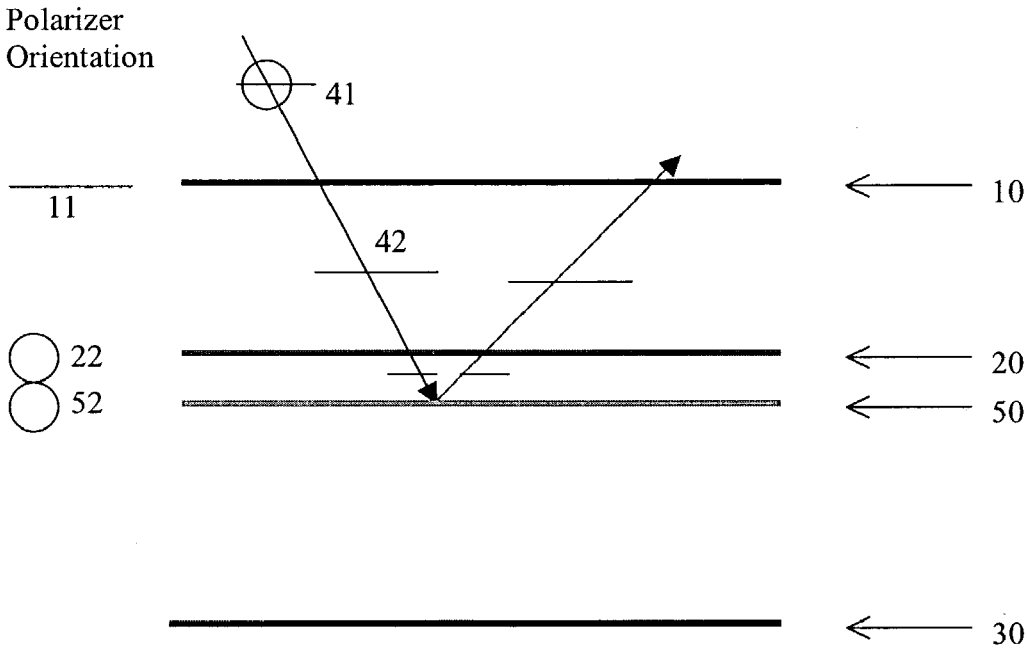
FIG. 4 is a schematic diagram illustrating the general principles of operation of the second preferred embodiment of FIG. 3 in a second operative mode.

To realize this design, a transreflective medium or polarizer is placed adjacent to the bottom surface of the second polarizer to enhance the brightness of the light emerging from the display arrangement 1 by reflecting a portion of light which has passed through the second polarizer 20, as more particularly shown in FIGS. 3 and 4.

Referring to FIGS. 3 and 4, a transflective film which reflects light of one polarization and transmits light of another polarization is adhered to the lower, or bottom, surface of the second polarizer 20. This will then form a transflective polarizer sub-assembly 80 including the second polarizer 20 and the transflective film 30. In order to enhance the intensity of the colour filtered incident light, the transflector 50 is disposed with its reflective orientation 52 aligned with the colour filtering orientation 22 of the colour polarizer. In other words, the transmissive orientation 51 of the transflector 50 is aligned with the second polarizing orientation 21. With this arrangement and when the Display is in its second operative mode, that is, when the colour filtering orientation 22 and the reflective orientation 52 are both parallel to the first polarizing orientation 11, the colour filtered light after passing through the colour polarizer 20 will be substantially reflected by the transflector 50 before reaching the display means 30.

Referring more particularly to FIGS. 5, 6, 8 and 9, there is shown an implementation of the display of the embodiment of FIGS. 3 and 4 in a wrist-watch. The wrist-watch includes a watch casing 60 on which there is housed an adjustment means. The adjustment means includes a turning knob 71 or crown which drives a shaft 72 into a rotational motion for turning the spindle 73 via a set of transmission gears 74. The upwardly extending spindle 73 includes a noncircular portion for driving engagement with a correspondingly shaped aperture formed in the middle of the sub-assembly 80 which comprises the second polarizer 20, the display surface 30 as the watch dial 30 and the transflective medium 50. The sub-assembly 80 can be formed by stacking or gluing the components together. As a variation, the display surface 30 can be painted, coated or formed on the bottom surface of the transflective medium 50. Of course, the sub-assembly can comprise the colour polarizer 20 and the transflective film 50 and be separated from the watch dial 30, so that the watch dial 30 is independent of the rotation of the sub-assembly.

Figure 5:
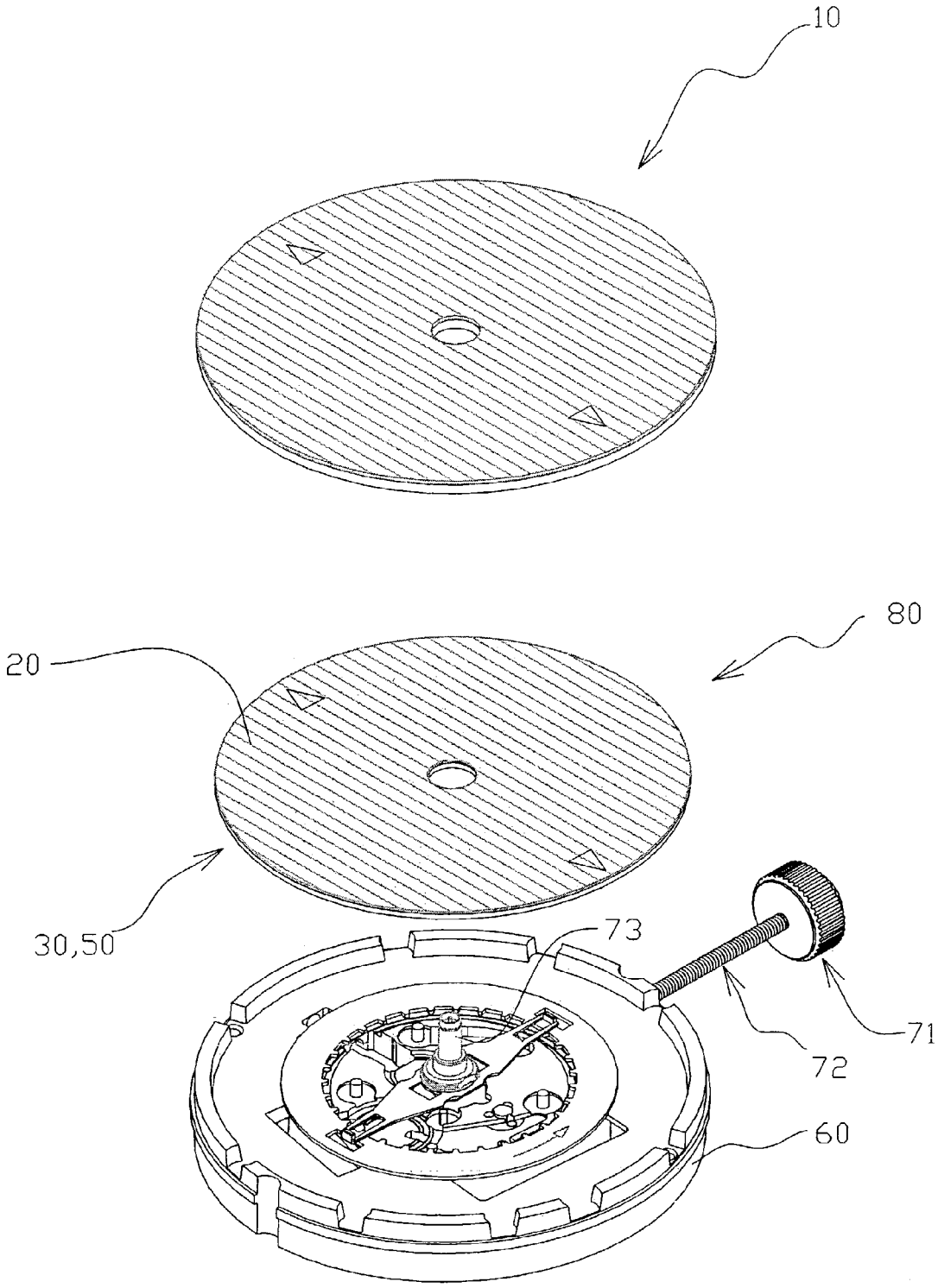
FIG. 5 is an exploded view showing an implementation of the invention in a wrist-watch in the first operative mode.

The first polarizer 10 in the present embodiment is supported on a transparent medium 12 such as a transparent sheet for added strength. An aperture which is larger than the cross-section of the spindle 73 is formed in the middle of the combined first polarizer 10 and the supporting transparent medium 12 so that rotation of the spindle is independent of the assembly of the first polarizer 10 and the supporting transparent medium 12. In the first operative mode as shown in FIG. 5 in which the first polarizer 10 and the second polarizer 20 are disposed with their polarizing orientations parallel, incident light impinging on the first polarizer 10 will pass through the second polarizer 20. The polarized light will then be reflected from the display means 30, which is the dial surface in the present specific example, back towards the viewer, carrying with it the colour and pattern of the watch dial 30.

Figure 6:
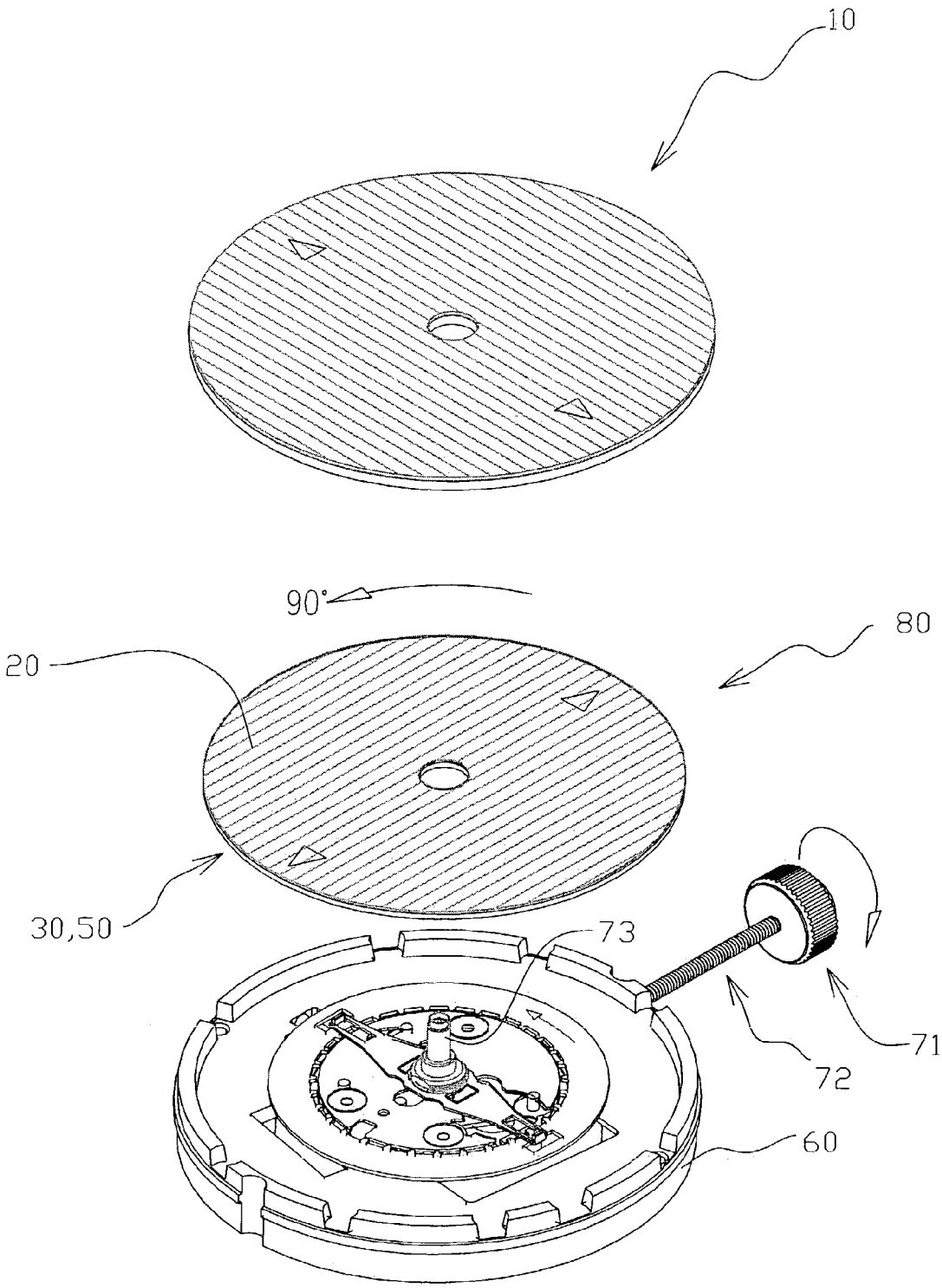
FIG. 6 is an exploded view showing an implementation of the invention in a wrist-watch in the second operative mode.

Referring now to FIG. 6 when the crown or turning knob 71 has been turned or rotated into the second operative mode, the colour polarizer-transflector sub-assembly 80, and therefore the second polarizer 20, has been turned by 90°. In this condition, the second polarizing direction 21 of the second polarizer 20 is now orthogonal to that of the first polarizer 10 and the colour filtering orientation 22 is parallel to the first polarizing orientation 11. Since only the component of the incident light having a polarization orientation parallel to the first polarizing orientation 11 can substantially pass through the first polarizer 10, the portion of the incident light reaching the sub-assembly 80 (including the second polarizer) will have a polarization orientation orthogonal to the second polarizing orientation 21 of the colour polarizer 20. As a result, the polarized incident light, having a polarization orientation parallel to the colour filtering orientation, will pass through the colour polarizer 20. Since the transflector 50 next layer is reflective to light polarized along the colour filtering orientation, this polarized filtered incident light will be blocked by the transflector 50 and will be reflected towards the viewer, carrying with it the colour of the second polarizer.

For example, if the colour polarizer is a blue polarizer and the surface of the watch dial is red, the colour which is apparent to the viewer in the arrangement of FIG. 5 will be red and that is apparent to the viewer in the arrangement of FIG. 6 will be blue. In addition, the colour which will be apparent to a user when the second polarizing sub-assembly 80 is intermediate between the parallel and the orthogonal polarizing directions will be a mixing of red and blue, namely, magenta.

It will be appreciated that the embodiment of FIGS. 1 and 2 can be similarly implemented in a wrist-watch similar to the construction described above without loss of generality, although the variable colour effect is different in the two embodiments. In addition, it will be noted that the displays of FIGS. 5 to 7 can be implemented with the rotation mechanism of FIGS. 8 and 9, as for examples.

Of course, the arrangement of FIGS. 5 and 6 can be modified so that the first polarizer 10 is rotatable by the turning knob without loss of generality.

Figure 7:
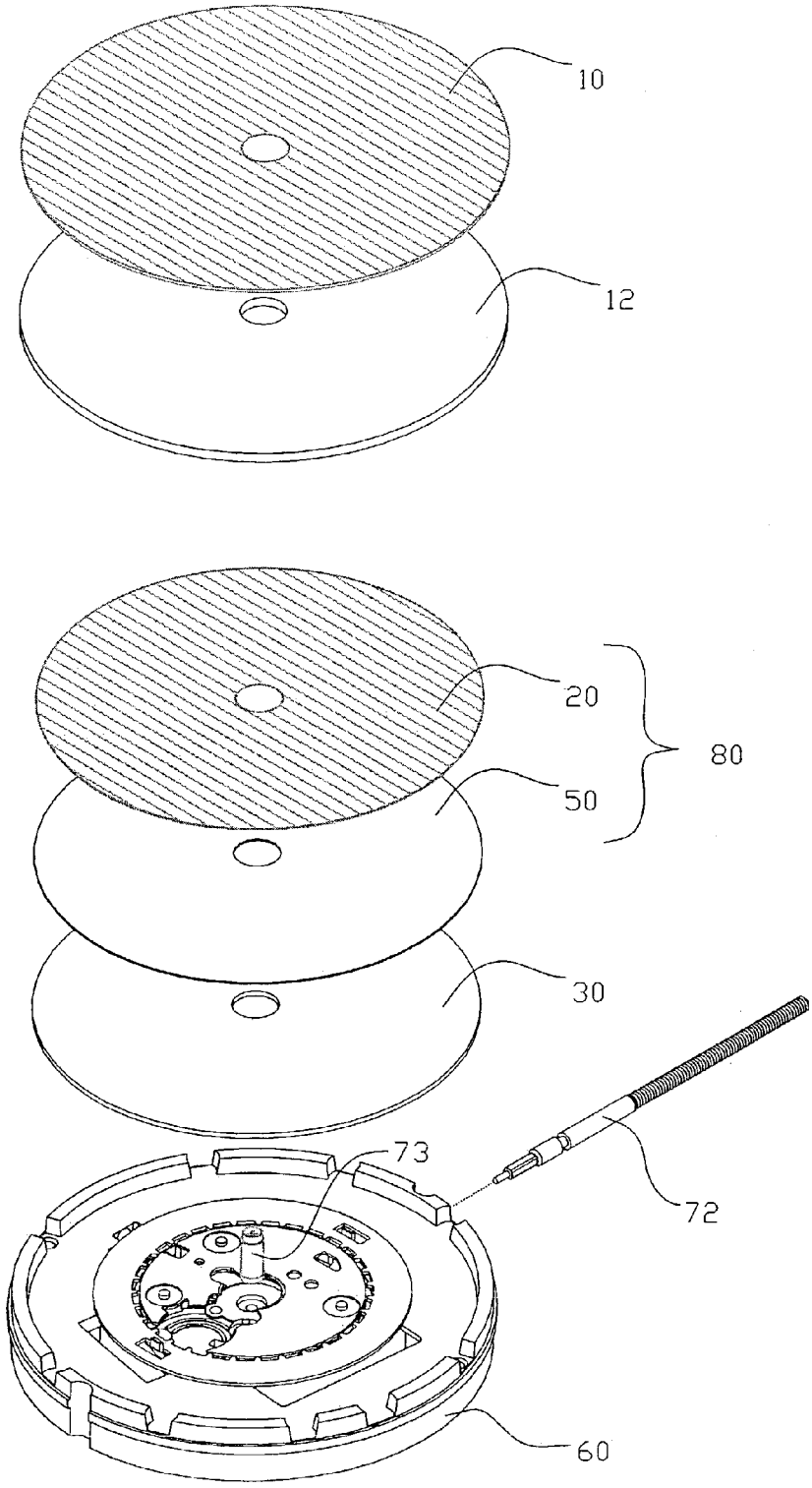
FIG. 7 is an exploded view showing a second preferred embodiment of the Display of the present invention implemented in a watch according generally to the schematic diagram of FIGS. 3 and 4.

In FIG. 7, there is shown a second preferred embodiment of the present invention also implemented as a wrist-watch. The construction of this embodiment is generally identical to that of FIG. 4 and the same reference numerals apply where appropriate. More specifically, the first polarizing means is supported on a transparent sheet 12 for physical enforcement or support. Also, the display means 30 in this embodiment is detached from the sub-assembly 80 of the colour polarizer 20 and the transflector 50 such that the display means is independent of the rotation of the sub-assembly 80. In this arrangement, the display means 30 can be made stationary or rotatable relative to the first polarizer 10.

Figure 8:
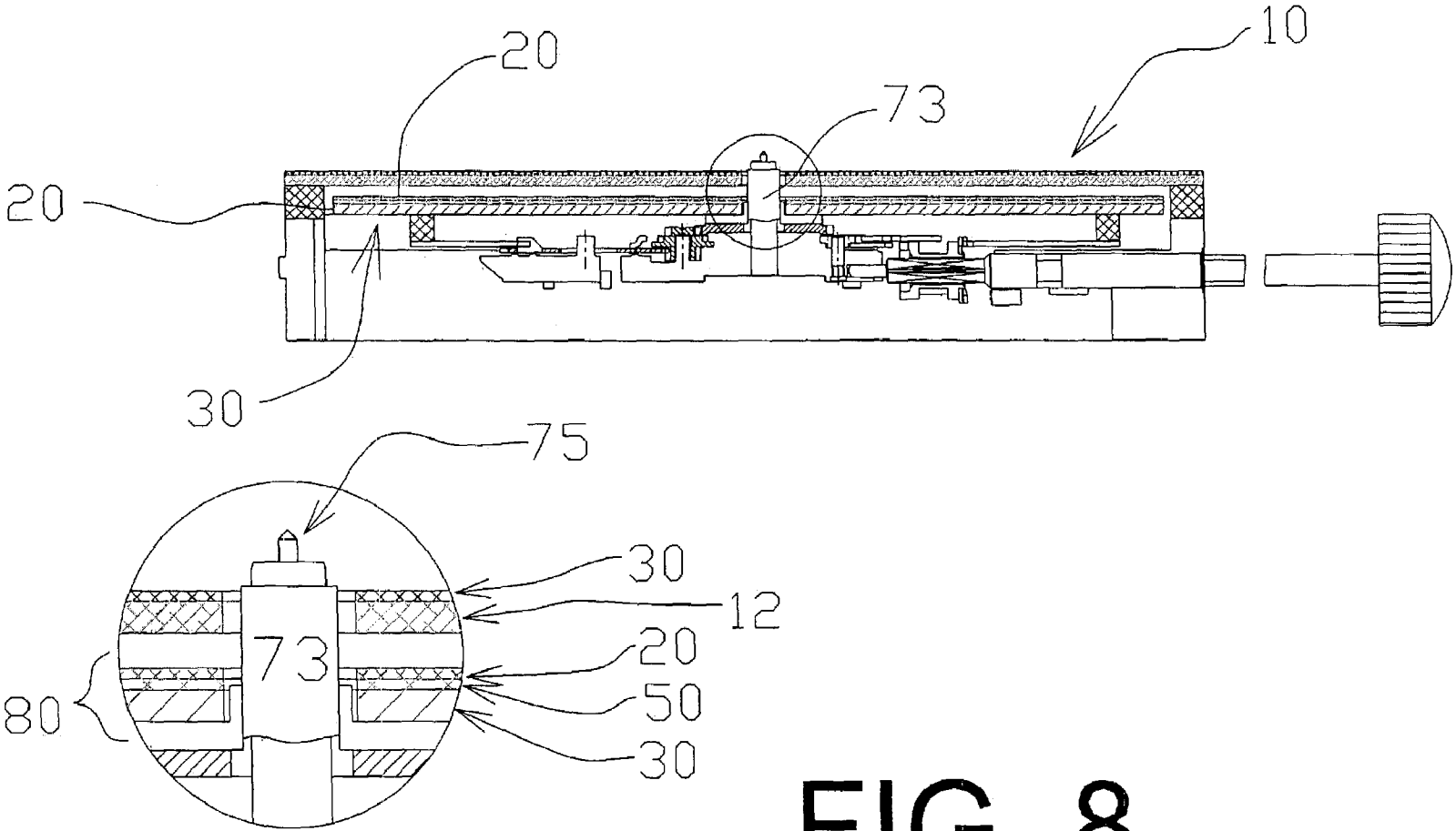
FIG. 8 is a cross-sectional view of an example of an arrangement for rotating the second polarizer with respect to the first polarizer.
Figure 9:
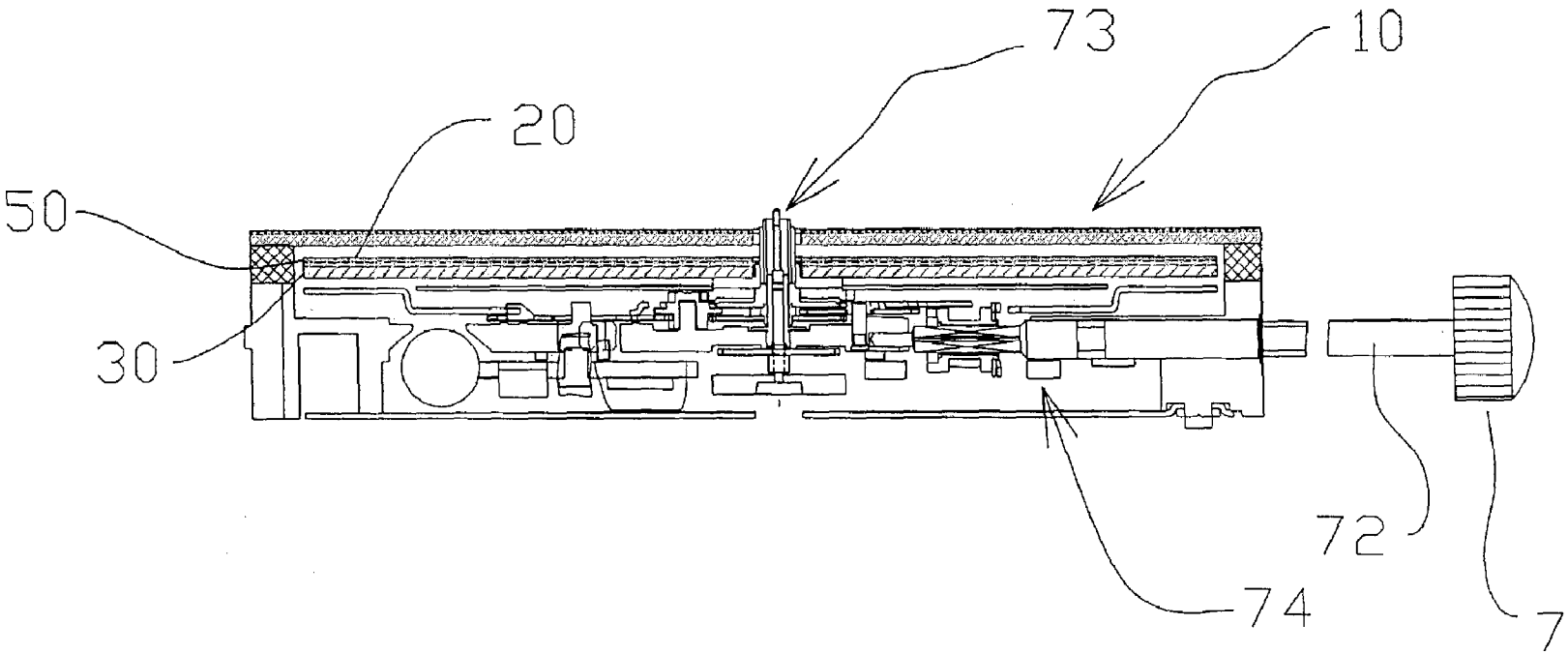
FIG. 9 is a simplified cross-sectional view of a watch arrangement with needles incorporating the example arrangement of FIG. 8.

Referring more specifically to FIG. 8, an embedded spindle 75 with its upper portion extending above the top of the spindle for driving the needles of a watch is connected to the movement mechanism of the watch. This spindle 75 is preferably independent of the movement of the dial 30 or the second polarizing sub-assembly 80 so that the watch needles can independently move. Of course, the movements of the needles and the dial 30 can also be made to be dependent.

As a further example, the display means or the display surface 30 can be lit, back-lit or illuminated so that colour variation can occur by relative movements of the first 10 and second 20 polarizing medium even in the absence of incident light.

While the present invention has been explained by reference to the preferred examples or embodiments described above, it will be appreciated that the embodiments are only illustrated as examples to assist understanding of the present invention and are not meant to be restrictive on its scope. In particular, the scope, ambit and spirit of this invention are meant to include the general principles of this invention as inferred or exemplified by the embodiments described above. More particularly, variations or modifications which are obvious or trivial to persons skilled in the art, as well as improvements made on the basis of the present invention, should be considered as falling within the scope and boundary of the present invention.

Furthermore, while the present invention has been explained by reference to various polarizers and optical films, it should be appreciated that the invention can apply, whether with or without modifications, to other arrangements or assembly of neutral and colour polarizers as well as other appropriate optical medium.

The invention claimed is:

1. A display means or arrangement including a first polarizing means, a second polarizing means, a display means, rotation means for causing relative rotation between said first and said second polarizing means, said second polarizing means being disposed intermediate of said first polarizing means and said display means, at least one of said polarizing means being a colour polarizer, said colour polarizer being characterised with a colour filtering orientation wherein light of a polarization orientation parallel to said colour filtering orientation will be substantially colour filtered when passing through said colour polarizer and light of a polarization orientation orthogonal to said colour filtering orientation will pass through said colour polarizer generally unaffected by the colour filtering characteristic of said colour polarizer along said colour filtering orientation, and said display means being generally reflective towards said first and second polarizing means, further including a transflective medium disposed between said colour polarizing means and said display means, said transflective medium being characterised with a reflective orientation and a transmissive orientation which are substantially orthogonal to each other, said transflective medium generally reflects light of one polarization orientation which is parallel to its characteristic reflective orientation, and transmits light of another polarization orientation which is parallel to said transmissive orientation.

2. A display means according to claim 1, said transflective medium includes a transflective film, wherein the reflective orientation of said transflective film being parallel to the colour filtering orientation of said colour polarizing means.

3. A display means according to claim 1, wherein said colour polarizing means includes a colour polarizing film, said colour filtering orientation of said colour polarizing means being substantially orthogonal to said transmissive orientation of said transflective medium.

4. A display means according to claim 1, wherein said colour polarizer and said transflective medium being contiguously stacked together.

5. A display means according to claim 4, wherein the reflective surface of said display means being contiguously stacked to said transflective medium.

6. A display means according to claim 1, wherein said second polarizing means being a colour polarizing means.

7. A display means according to claim 1, wherein the reflective surface of said display means includes a colour which is different to the characteristic colour of said colour polarizing means.

8. A display means according to claim 1, wherein said second polarizing means includes a colour polarizer which is rotatable by a gear transmission connected to a turning knob.

9. A display means according to claim 1, wherein said colour polarizing means and said transflective medium are a sub-assembly, said sub-assembly being connected to a turning knob via a transmission arrangement so that said colour polarizing means and said transflective medium are rotatable together.

10. A display means according to claim 2, wherein said colour polarizing means and said transflective medium are a sub-assembly, said sub-assembly being connected to a turning knob via a transmission arrangement so that said colour polarizing means and said transflective medium are rotatable together.

11. A watch including time indicating needles and a display means or arrangement of claim 1, wherein said first polarizing means, said second polarizing means and said display means are disposed intermediate between said time indicating needles and the movement mechanisms driving said needles.

12. An article, an apparatus or a device including the display means or arrangement of claim 1.

* * * * *